United States Patent [19]

Oberhoff et al.

[11] 4,245,413

[45] Jan. 20, 1981

[54] AUTOMATIC TOWEL DISPENSER

[75] Inventors: Wolfgang Oberhoff, Krefeld; Hugo W. Geschka, Düsseldorf, both of Fed. Rep. of Germany

[73] Assignee: Eisen- und Metallindustrie E. Blum Kg, Vaihingen/Enz, Fed. Rep. of Germany

[21] Appl. No.: 55,915

[22] Filed: Jul. 9, 1979

Related U.S. Application Data

[63] Continuation of Ser. No. 941,852, Sep. 13, 1978, abandoned, which is a continuation of Ser. No. 761,878, Jan. 24, 1977, abandoned.

[30] Foreign Application Priority Data

Jan. 22, 1976 [DE] Fed. Rep. of Germany ..... 2602278

[51] Int. Cl.[3] ..... A47K 10/30

[52] U.S. Cl. ..... 38/2; 68/13 R; 68/19.1; 68/20; 68/92; 68/175

[58] Field of Search ..... 68/9, 13 R, 19.1, 20, 68/27, 38, 85, 92, 175; 226/127-133; 221/27-29; 312/38; 38/2, 7; 21/81; 34/157; 15/40

[56] References Cited

U.S. PATENT DOCUMENTS

| | | | |
|---|---|---|---|
| 2,218,677 | 10/1940 | Haas | 34/157 X |
| 2,295,955 | 9/1942 | LaPage | 68/13 R X |
| 2,609,623 | 9/1952 | Miller | 38/2 |
| 3,083,481 | 4/1963 | Kamen | 38/2 |
| 3,112,631 | 12/1963 | Gordon | 68/13 R X |
| 3,762,870 | 10/1973 | Probst et al. | 68/85 X |

FOREIGN PATENT DOCUMENTS

| | | | |
|---|---|---|---|
| 506389 | 9/1930 | Fed. Rep. of Germany | 68/13 R |

*Primary Examiner*—Philip R. Coe
*Attorney, Agent, or Firm*—Herbert L. Lerner

[57] ABSTRACT

Automatic towel dispenser has a box-shaped housing provided with a washing chamber and a drying chamber for an endless towel to be guided therethrough, the towel having a cleaned partial length thereof available for respective use and being guidable over a locking device for limiting the clean partial length of the towel to be withdrawn and guided outside the housing between an outlet opening and an inlet opening formed in the housing, a first storage chamber located in the housing between the inlet opening and the washing chamber for variably piling up therein a plurality of used partial lengths of the towel, and a second storage chamber located in the housing between the drying chamber and the outlet opening for variably piling therein a plurality of cleaned partial lengths of the towel, and means being activatable, upon the emptying to a given extent of the cleaned partial lengths of the towel in the second storage chamber, for passing used partial lengths of the towel through the washing and drying chamber during start-up of a washing and drying operation and for depositing cleaned partial lengths of the towel in the first storage chamber.

14 Claims, 2 Drawing Figures

AUTOMATIC TOWEL DISPENSER

Figure 1:
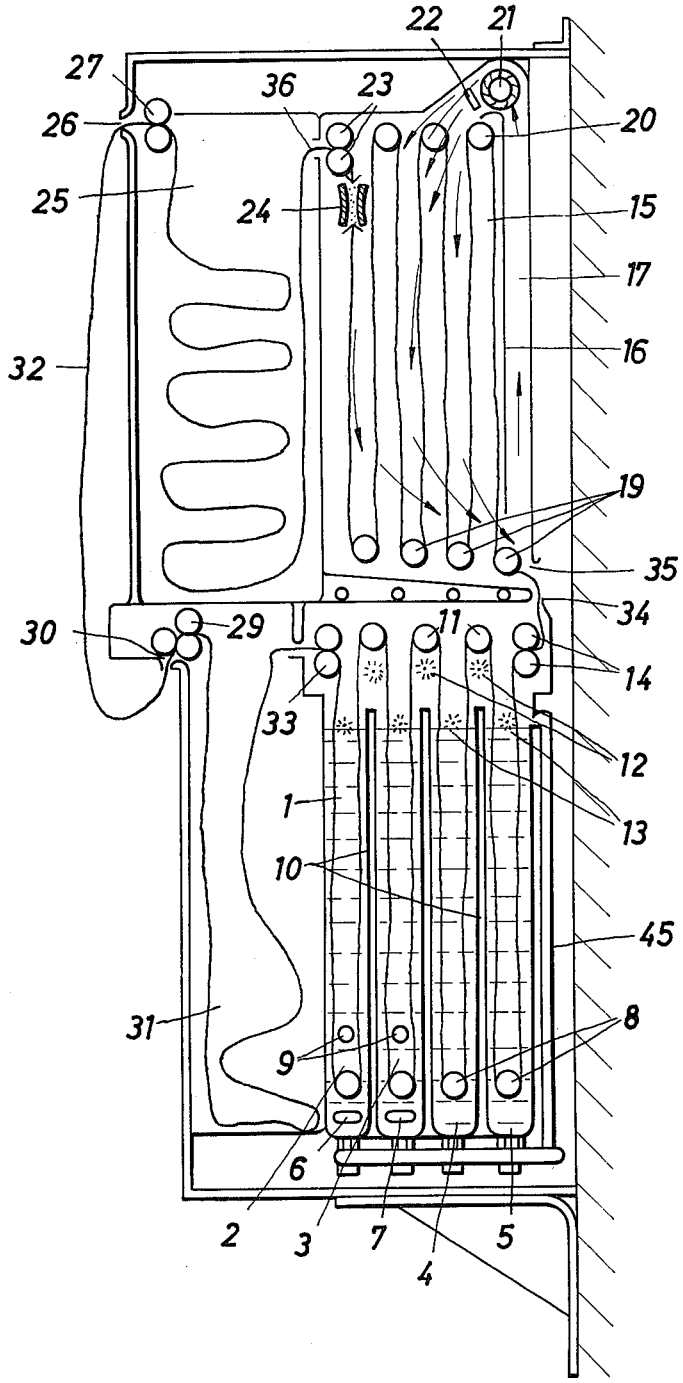

This is a continuation, of application Ser. No. 941,852, filed Sept. 13, 1978 which is a continuation of Ser. No. 761,878, filed Jan. 24, 1977, both abandoned.

The invention relates to an automatic towel dispenser, especially for wall suspension, and, more particularly, to such a towel dispenser that has a box-shaped housing provided with a washing chamber and a drying chamber for an endless towel to be guided therethrough, the towel having a cleaned partial length thereof available for respective use and being guided outside the housing between an outlet opening or slot and an inlet opening or slot, a first storage chamber located in the housing between the inlet slot and the washing chamber for variably piling up therein a plurality of used partial lengths of the towel, and a second storage chamber located in the housing between the drying chamber and the outlet opening for variably piling up therein a plurality of cleaned partial lengths of the towel and, upon the emptying to a given extent of the cleaned partial lengths of the towel in the second storage chamber, passing used partial lengths of the towel through the washing and drying chambers during start-up of a washing and drying operation and depositing cleaned partial 1 lengths of the towel in the first storage chamber.

Automatic towel dispensers of the foregoing type are known from U.S. Pat. No. 2,295,955. These known towel dispensers differ from other heretofore known automatic towel dispensers primarily in that they, in an advantageous manner, are provided with a respective storage chamber for variable piling or stacking of a plurality of used and cleaned partial towel lengths, because only thereby, when required, a greater or longer partial towel length can be regularly, washed, rinsed, dried and, if necessary, ironed, respectively, and moreover in a continuous operation. If such storage chambers for variably piling or stacking a plurality of used as well as cleaned partial towel lengths are not provided, then the cleaning process must be performed, respectively, after every individual use of the towel dispenser, whereby no regular cleaning of the towel can be achieved because the individual work stations cannot be continuously traversed by the partial towel length that is to be cleaned. It is therefore essential for the practical application of such automatic towel dispensers, that they be provided with two storage chambers for variably piling or stacking an adequate supply of cleaned and soiled partial towel lengths.

In the heretofore known automatic towel dispensers, both storage chambers for the variable or loose piling or stacking of the cleaned and soiled partial towel lengths are disposed together with the washing, rinsing and drying chambers respectively above one another and, in fact, from the bottom to the top in the following series or order: washing chamber, storage chamber for used towel sections, rinsing chamber, drying chamber with a pressing iron-type heating device and an upper storage chamber for a loose pile of cleaned towel sections. Since the washing and rinsing chamber, in these automatic towel dispensers, are, respectively, formed of shallow vessel shells to be filled with washing or rinsing liquid, which are respectively traversed only flatly horizontally by the respective towel sections that are to be cleaned, the respective towel sections can be washed and rinsed only rather inadequately because the respective lengths of treatment both as to the length of time involved as well as to the length of towel involved i.e. temporally as well as spatially, are too short to permit an intensive washing and rinsing treatment. Also, in this relatively simple washing vessel shell, no prewashing with correspondingly lower prewashing temperature is possible, which is essential for the removal, especially, of albuminous towel soilings. Furthermore, in this heretofore known automatic towel dispenser, no adequate drying of the cleaned towel sections is possible, because the pressing iron-type heating device, by itself, is insufficient therefor. Finally, the disposition of all of the treatment and storage-piling stations above one another requires that relatively long, otherwise useless transporting paths with a multiplicity of reversing or deflecting guides for the respective towel sections be provided.

It is accordingly an object of the invention to provide an automatic towel dispenser which, while maintaining the advantages resulting from having two storage chambers for the variable piling or stacking of a plurality of used as well as cleaned towel sections or lengths, no longer possesses the aforementioned disadvantages peculiar to the heretofore known towel dispensers of this type.

It is a more specific object of the invention to provide such an automatic towel dispenser of this type that is of simpler construction and, primarily, having an improved operation over those of the prior art as will afford trouble-free washing, rinsing, drying and smoothing out, such as by ironing, for example, of a respective greater towel section or length.

With the foregoing and other objects in view, there is provided, in accordance with the invention, an automatic towel dispenser having a box-shaped housing provided with a washing chamber and a drying chamber for an endless towel to be guided therethrough, the towel having a cleaned partial length thereof available for respective use and being guidable over a locking device for limiting the clean partial length of the towel to be withdrawn and guided outside the housing between an outlet opening and an inlet opening formed in the housing, a first storage chamber located in the housing between the inlet opening and the washing chamber for variably piling up therein a plurality of used partial lengths of the towel, and a second storage chamber located in the housing between the drying chamber and the outlet opening for variably piling up therein a plurality of cleaned partial lengths of the towel, and means being activatable, upon the emptying to a given extent of the cleaned partial lengths of the towel in the second storage chamber, for passing used partial lengths of the towel through the washing and drying chamber during start-up of a washing and drying operation and for depositing cleaned partial lengths of the towel in the first storage chamber, a plurality of guide rollers disposed at the bottom and the top of both the washing chamber and the drying chamber for the endless towel in a multiplicity of vertically extending loops, the washing chamber comprising at least two washing sections and at least one rinsing section, the sections being separated by respective partitions disposed between the vertically extending loops, an air shaft separated by a partition form the drying chamber, heating means and blower means, both disposed at the top of the drying chamber, the blower means, the heating means and the air shaft cooperating to produce a circulating dry air current flowing downwardly through the drying chamber.

Due to the multiple loop guidance of the endless towel in the washing chamber as well as in the drying chamber, a markedly more intensive washing and drying treatment of the respective partial towel lengths or sections can be achieved whereby, due to the subdivision of the washing chamber into a plurality of washing and, if desired, also rinsing sections, an individually, suitably varying washing and rinsing treatment, for example with respective prewashing and main washing or prerinsing and clear rinsing becomes possible.

The multiple loop guidance of the respective towel sections or lengths in the drying chamber as well as the circulating dry air produced by the blower, such as a cross-current blower, and the respective heating device and flowing downwardly through the drying chamber permit a most extensively free application of drying air to all of the towel lengths or sections that may be present therein, resulting in a trouble-free and rationally effected drying because, in connection with the aspirating or suction shaft separated by a partition from the drying chamber, the dry air can be guided in a circulatory loop. Since the individual treatment stations furthermore are respectively directly connected to one another and thus do not require any very lengthy, otherwise unused transporting paths disposed between the stations, the transporting path for the respective towel sections or lengths are consequently optimally utilized for the individual cleaning treatments with the automatic towel dispenser according to the invention.

In accordance with another feature of the invention, the first storage chamber and the washing chamber are disposed at the same level behind one another, and the second storage chamber and the drying chamber are located above the first storage chamber and the washing chamber and are disposed at the same upper level behind one another. This provides structurally a very compact arrangement of the towel dispenser, especially also if, in accordance with a further feature of the invention, the washing chamber and the drying chamber located above the washing chamber are substantially equal in size. This feature is also advantageous for the cleaning treatment because respective towel sections of equal length would be disposed both in the washing chamber as well as in the drying chamber.

In accordance with an added feature of the invention, the outlet opening for the clean partial length of the towel is located near the top of the housing, the drying chamber has a passageway opening for the endless towel into the first storage chamber, a roller pair for advancing the endless towel is disposed in the drying chamber adjacent the passageway opening, and an ironing device is located immediately ahead of the roller pair in travel direction of the endless towel. Moreover, the ironing device can be formed of a pair of heatable iron plates or cheeks engaging one another with mutually opposing pressure.

The ironing device ensures that the towel section or length adequately dried in the drying chamber is delivered in sufficiently smoothed or ironed condition to the storage chamber for clean traveling. In order to pile or stack the towel loosely in trouble-free fashion, it is advantageous, in accordance with the invention, to provide the passageway opening or slot leading from the drying chamber to the first storage chamber as well as the outlet opening or slot leading outwardly from the first storage chamber respectively in the upper region of first storage chamber, because then only one undisturbed pile or stack of the respective towel sections or lengths in the first storage chamber is to be achieved through the respective inward and outward travel of the respective partial towel lengths. In accordance with other features of the invention, a transporting roller pair is disposed in the upper region of the first storage chamber i.e. for clean toweling, and at the outlet of the drying chamber or the inlet to the first storage chamber, the roller pair serving to advance the dried towel sections or lengths into the first storage chamber. In accordance with yet another feature of the invention, a roller pair is provided in the upper region of the first storage chamber in association with the outlet opening thereof, whereby initially the withdrawal of the towel from the pile or stack is facilitated and whereby, simultaneously, a feed blocking device can be actuated and, furthermore, a counting mechanism for releasing the washing and drying operation can be actuated.

For effecting trouble-free feeding, piling and removal of the used towel into and out of the second storage room i.e. for the used towel, there is provided in accordance with an additional feature of the invention, a towel dispenser wherein the inlet opening in the housing for the used partial length of the towel, a roller pair disposed in the second storage chamber adjacent the inlet opening, and a roller pair disposed in the washing chamber adjacent an entrance thereto from the second storage chamber are all located at an upper part of the second storage chamber. Undisturbed piling of the respective used towel sections or lengths in the second storage chamber is thus attainable through the respective inward and outward travel of the corresponding partial towel lengths.

Guidance of the towel both in the washing as well as in the drying chamber is effected, in accordance with an added feature of the invention, by disposing the plurality of guide rollers at the bottom and at the top of both the washing chamber and the drying chamber in mutually staggered relationship, the guide rollers being freely rotatable.

In accordance with yet a further feature of the invention, respective overflows are disposed within the individual washing and rinsing sections of the washing chamber, and electrically driven roller brushes are disposed substantially at the level of the overflows between the individual loops of the endless towel. The roller brushes not only ensure a direct mechanical cleaning contact of the respective towel sections or lengths, but also for a displacement or agitation of the washing and rinsing baths. Further in accordance with the invention, the guide rollers at the top of the washing chamber are respectively disposed over the partitions in spaced relationship to the respective upper edges of the partitions, and additional roller brushes are provided, respectively mounted between the upper edges of the partitions and the respective guide rollers disposed thereover. The latter additional roller brushes ensure that the sides of the towel transported in multiple loop form that are not directly subjected to the first-mentioned lower roller brushes, will be brushed and will accordingly be mechanically cleaned.

In accordance with another feature of the invention, the towel dispenser includes a roller pair disposed in the drying chamber adjacent a passageway opening therefrom into the first storage chamber, and another roller pair disposed in the washing chamber adjacent a passageway opening therefrom into the drying chamber, means for driving both of the roller pairs so as to advance the endless towel through the washing chamber and the drying chamber, and means operatively connected to the driving means for controlling the driving means in a thermostatically dependent manner.

In accordance with a further feature of the invention, the towel dispenser includes means for driving the roller brushes disposed between the loops of the endless towel and the additional roller brushes mounted between the upper edges of the partitions and the respective guide rollers disposed thereover, and means operatively connected to the driving means for controlling the driving means in a thermostatically dependent manner.

In accordance with a concomitant feature of the invention, the towel dispenser includes means for adding washing medium to the washing chamber, and means operatively connected to the means for adding washing medium for controlling the latter in a thermostatically dependent manner.

Other features which are considered as characteristic for the invention are set forth in the appended claims.

Although the invention is illustrated and described herein as embodied in an automatic towel dispenser, it is nevertheless not intended to be limited to the details shown, since various modifications and structural changes may be made therein without departing from the spirit of the invention and within the scope and range of equivalents of the claims.

Figure 2:
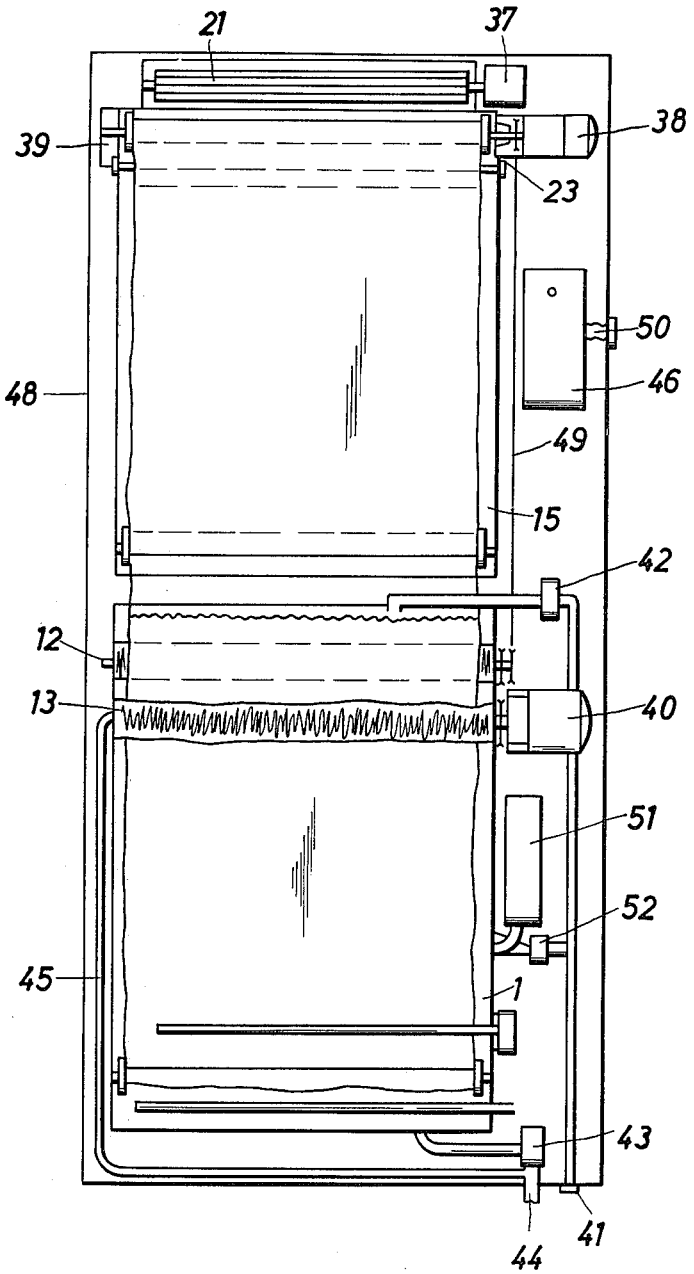

The construction and method of operation of the invention, however, together with additional objects and advantages thereof will be best understood from the following description of specific embodiments when read in connection with the accompanying drawings, in which:

FIG. 1 is a vertical sectional view, of an automatic towel dispenser according to the inventor, the plane of the section being traverse to the surface of a wall to which the dispenser is attached; and FIG. 2 is another vertical sectional view of the dispenser, the plane of the section being transverse to that of FIG. 1, Referring now to the figures of the drawing, the automatic towel dispenser of the invention is shown therein and includes a wash tub defining a washing chamber 1 and divided into several trough-shaped compartments separated from one another, namely, a prewashing trough 2, a clear washing trough 3 and two rinsing troughs 4 and 5. An electric heating rod 6, 7 is disposed, respectively, in each of the troughs 2 and 3. In the lower region of all the troughs 2 to 5, loosely mounted lower guide rollers 8 are disposed. The individual troughs 2 to 5 are separated by partitions 10 one from another. A loosely mounted, upper guide roller 11 together with a respective electrically driven upper roller brush 12 is located above the respective partitions 10. A respective electrically driven lower roller brush 13 is also disposed at the height of an overflow 45 determining the water level in each individual trough 2 to 5. An electrically driven roller pair 14 under mutually applied pressure and serving to drain or wring water from an endless towel 32 is disposed at least above the last rinsing trough 5. A respective thermostat 9 is furthermore disposed in the troughs 2 and 3 for limiting the washing temperatures, for cutting off the heating and the towel feed.

A vessel-like drying chamber 15 is substantially equal in size to the washing chamber 1 and, like the latter, is of box-type construction, and is disposed above the latter. Adjacent the drying vessel 15 is a storage chamber 25 for clean toweling that is to be piled or stacked variably as shown in FIG. 1. This storage chamber 25 is connected functionally upstream of the drying vessel 15 in direction of travel of the towel 32. A partition 16 is disposed in the drying vessel 15, defining therein a downwardly opening air shaft 17. In addition, lower guide rollers 19 are located in the drying vessel 15, in vicinity of the base thereof, and upper guide rollers 20 in vicinity of the cover thereof. A cross-current blower 21 with a heating device 22 is disposed above the drying vessel 15, and blows warm air downwardly into the drying vessel 15. An electrically driven roller pair 23 is disposed in the drying vessel 15 adjacent an outlet opening 36 for the towel 32. An ironing device 24 formed of two electrically heated ironing plates is disposed upstream of the roller pair 23 in travel direction of the endless towel 32. In the adjacent storage chamber 25 for clean toweling, a roller pair 27, which is connected to a conventional counting device 39, is located directly in front of the outlet opening 26 for the towel 32. The conventional counting device 39 counts the number of times the towel 32 has been used. When the loop of the endless towel 32 hanging outside the towel dispenser is pulled, a predetermined length of the towel 32, limited by a non-illustrated conventional transport blocking device, emerges from the outlet opening 26 and, through the roller pair 29 running synchronously with the roller pair 27, passes through an inlet opening 30 into a storage chamber 31 for used i.e. soiled, toweling.

The wash tub 1 is located below the drying vessel 15 whereon the drying blower 21 with the drive 37 therefor is seated. The roller pairs 14 and 23, which effect the towel feed, are driven by a geared motor 38. A motor 40 drives the roller brushes 12 and 13 which produce the mechanical components of the washing operation. The roller pair 27 actuated by a respective pull or tug of the towel 32 is connected to the conventional counting mechanism 39 which, after a predetermined number of times that the towel 32 has been used, releases the next washing and drying action cycle for the next portion of towel length.

The fresh water supply of the towel dispenser according to the invention is provided through a union 41 and a valve 42. Waste water travels through a discharge valve 43 and a union connecting tube 44 into a canalization. The overflow 45, which branches off from the individual wall and rinsing compartments at the level of the roller brushes 13, by-passes the discharge valve 43 and controls the water level in the individual troughs of the wash tub 1. The control mechanism 46 with an electric terminal 50 controls the individual washing, rinsing and drying operations automatically. From a respective washing-medium container 51 for pre-washing and clear washing, at a corresponding instant of time, the addition of washing medium is effected through a valve 52.

The towel dispenser according to the invention has an outer housing 48 of box-type construction and is provided with devices to effect the suspension thereof from a wall.

The endless towel 32 is guided out of the storage chamber 31 for used or soiled toweling through an inlet opening to and over a roller pair 33 disposed in the wash tub 1, into the prewashing trough 2 in the wash tub 1, around a lower guide roller 8 to and around the upper guide roller 11 into the clear washing trough 3 and, in a similar manner, through the rinsing troughs 4 and 5 as well as finally through the roller pair 14, until it leaves the wash and rinsing tub 1 through the outlet opening 34, so as to reach the drying vessel 15 through the inlet opening 35 thereto. In the drying vessel 15, the towel 32 is guided, in a manner similar to that in the wash tub 1, over lower guide rollers 19 and upper guide rollers 20 loopwise back and forth to the ironing device 24 from which, after being guided through the roller pair 23, it extends into the storage chamber 25 for clean toweling. The towel 32 leaves the storage chamber 25 after passing through the roller pair 27 with the counting device 39, and extends out of the housing 48 through the upper, outlet opening 26 formed therein. The towel 32 is then returned into the housing 48 through the lower, inlet opening 30, and extends over the roller pair 29 again into the storage chamber 31 for used or soiled toweling.

The automatic towel dispenser according to the invention, operates as follows:

If the counting device 39 determines, in a conventional manner, that the quantity or length of clean toweling in the storage chamber 25 has dropped below a given minimum, it gives the conventional control device 46 a command to release or initiate a washing and drying operation.

Water runs into the troughs 2, 3, 4 and 5 through the electrically controlled fresh water valve 42. The overflow 45 provides for maximal water level. The electric heating devices 6 and 7 are of such dimension that the required pre-washing temperature in the trough 2 is attained nearly at the same instant of time as is the required clear washing temperature in the trough 3. The thermostat 9 in the trough 3 then switches off the washing heaters 6 and 7. The motor 40 for the roller brushes 12 and 13, the motor 38 for the roller pairs 23 and 14 as well as the blower 21 with the heater 22 are switched on. Simultaneously, the addition of washing medium into the troughs 2 and 3 from the washing medium containers 51 is effected.

The endless towel 32 is positively guided and advanced with a predetermined velocity for a predetermined time period through the washing and rinsing troughs 2 to 5 of the tub 1 and through the drying vessel 15. A feed cycle advances the towel 32 substantially an additional length thereof corresponding to a length that is located in the troughs of the wash tub 1. During the transport of the towel 32, it initially extends into the pre-wash trough 2 wherein it is wetted at a temperature of substantially 37° C. by the pre-washing solution and mechanically cleaned by the roller brushes 12 and 13. From the pre-wash trough 2, the towel 32 travels into the main washing trough 3 wherein the operation is repeated exactly, and just the same also in the rinsing troughs 4 and 5. After passing through the troughs 2 to 5, the towel 32 is washed and rinsed. During the passage of the towel 32 between the rollers of the roller pair 14, the towel 32 is dewatered or drained of water. The towel 32 then travels into the drying vessel 15 through which it also passes, becoming dried therein as a result of the warm air current produced therein. Finally, the towel 32 runs through and between the electrically heated plates of the ironing device 24 and passes over the roller pair 23 into the storage chamber 25 for washed i.e. clean, toweling.

In addition to the hereinafore-mentioned advantages of the invention, the following additional advantages are provided thereby:

Due to the positive guidance of the endless towel 32 in the wash tub 1 over lower and upper rollers 8 and 11, respectively, and in the drying chamber 15 over lower and upper rollers 19 and 20, respectively, on the one hand, and the loose piling or stacking thereof into the storage chambers 25 and 31, on the other hand, the substantially continuously occurring washing and drying operations can take place undisturbed by the frequency of use of the towel 32. Due to the division of the washing chamber 1 into the pre-washing trough 2, the clear washing bath 3 and two rinsing troughs 4 and 5, a new washing and drying operation with continuous feed can be begun at any desired instant of time when the temperature in the various washing tubs has been attained. Through the lower guide rollers 8 loosely mounted in the lower part of the individual washing troughs of the wash tub 1 and the electrically driven lower roller brushes 13 disposed at the height of the overflow 45 which determines the water level, the loops of the towel 32, during the passage thereof through the washing and rinsing troughs 2 to 5, are maintained respectively at a constant mutual spacing so that the roller brushes can effect the mechanical cleaning of the one side of the towel 32. Simultaneously, the roller brushes 13 ensure circulation of the washing solution or the rinsing water, as the case may be. The upper guide rollers 11 loosely mounted above the partitions 10 together with the electrically driven roller brushes 12 disposed thereat also effect a constant mutual spacing of the towel loops in the washing and rinsing troughs 2 to 5, the roller brushes 12 together taking care of the mechanical cleaning of the other side of the towel 32. The roller pair 14 disposed above the last rinsing trough 5 and under mutually applied pressure assures that the towel 32 leaves the wash tub 1 after having been previously dewatered or drained. Due to the lower guide rollers 19 loosely mounted in vicinity of the base of the drying chamber 15, and the upper guide rollers 20 disposed in vicinity of the cover of the drying chamber 15, the positive guidance of the towel 32 in the drying vessel 15 is effected so that the drying air can be blown unhindered into the valleys of the multi-looped towel 32, and all parts of the towel 32 can thus be swept intensively by the drying air current. Due to the downwardly opening shaft 17 separated by the partition 16 from the drying vessel 15 and extending upwardly into the suction intake side of the cross-current blower 21, a dry air-positive circulation travelling downwardly i.e. counter to the striving of the warm air to rise, is produced within the drying vessel 15, whereby a longer dwell of the warm air in the towel 32 and more intensive drying accordingly are achieved. The roller pair 27 disposed at the outlet opening of the storage chamber 25 for washed i.e. cleaned, toweling together with the transport blocking device and counting device 39, which are so interlocked with the electric control device 46 that only the counting mechanism 39 can release or clear the start of a washing and drying operation, ensure that a washing and drying operation will be automatically begun only if required. The additionally existing synchronous drive of both roller pairs 23 and 14 by the motor 38 ensures that the same feed velocity prevails both in the wash tub 1 as well as in the drying vessel 15. Since the spatial depth of the storage chamber 31 together with the wash tub 1 is less than the spatial depth of the storage chamber 25 together with the drying chamber 15, a rebound for the inlet opening 30 is produced, whereby a more convenient or easier handling of the towel is attained. In addition, the advantageous control through the thermostats for example, should be mentioned. Thereby, both the synchronization of the drive 38 of the guide or conveying rollers 14 and 23, which effect the travel of the towel through the washing chamber 1 and the drying chamber 15, as well as the synchronization of the drive 40 of the roller brushes 12 and 13 and also the addition of the washing medium, respectively, can be thermostat-dependent.

There are claimed:

1. Automatic towel dispenser having a box-shaped housing provided with a mutually separated washing chamber and a drying chamber for an endless towel to be guided therethrough, an outlet opening and an inlet opening formed in said housing, the towel having a cleaned partial length thereof available for respective use and being guidable over a locking device for limiting the clean partial length of the towel to be dispensed and guided outside the housing between said outlet opening and said inlet opening formed in the housing, a first storage chamber, as viewed in travel direction of the towel, located in the housing between the inlet opening and the washing chamber for variably piling up therein a plurality of used partial lengths of the towel, and a second storage chamber, as viewed in travel direction of the towel, located in the housing between the drying chamber and the outlet opening for variably piling up therein a plurality of cleaned partial lengths of the towel, and means being activatable, upon the emptying to a given extent of the cleaned partial lengths of the towel in the second storage chamber, for passing used partial lengths of the towel through the washing and drying chamber after start-up of a washing and drying operation and for depositing cleaned partial lengths of the towel in the second storage chamber, the improvement therein comprising a plurality of guide rollers disposed in a respective upper and lower region of both the washing chamber and the drying chamber for guiding the endless towel in a multiplicity of loops, the washing chamber comprising at least one washing section and at least one rinsing section, said section being separated by respective partitions, an air shaft separated by a partition from said drying chamber, heating means and blower means both disposed in the drying chamber, said blower means, said heating means and said air shaft cooperating to produce a circulating dry air current flowing through the drying chamber, and means for depositing and stacking the cleaned and dried partial lengths of the towel and the used partial lengths of the towel from above into the respective second and first storage chambers and for withdrawing them upwardly from below the stored supply disposed thereabove.

2. Towel dispenser according to claim 1 wherein said first storage chamber and said washing chamber are disposed at the same level behind one another, and said second storage chamber and said drying chamber are located above said first storage chamber and said washing chamber and are disposed at the same upper level behind one another.

3. Towel dispenser according to claim 2 wherein said washing chamber and said drying chamber located above said washing chamber are substantially equal in size.

4. Automatic towel dispenser having a box-shaped housing provided with a washing chamber and a drying chamber for an endless towel to be guided therethrough, an outlet opening and an inlet opening formed in said housing, the towel having a cleaned partial length thereof available for respective use and being guidable over a locking device for limiting the clean partial length of the towel to be dispensed and guided outside the housing between said outlet opening and said inlet opening formed in the housing, a first storage chamber, as viewed in travel direction of the towel, located in the housing between the inlet opening and the washing chamber for variably piling up therein a plurality of used partial lengths of the towel, and a second storage chamber, as viewed in the travel direction of the towel, located in the housing between the drying chamber and the outlet opening for variably piling up therein a plurality of cleaned partial lengths of the towel, and means being activatable, upon the emptying to a given extent of the cleaned partial lengths of the towel in the second storage chamber, for passing used partial lengths of the towel through the washing and drying chamber after start-up of a washing and drying operation and for depositing cleaned partial lengths of the towel in the second storage chamber, the improvement therein comprisng a plurality of guide rollers disposed in a respective upper and lower region of both the washing chamber and the drying chamber for guiding the endless towel in a multiplicity of loops, the washing chamber comprising at least one washing section and at least one rinsing section, said sections being separated by respective partitions, an air shaft separated by a partition from said drying chamber, heating means and blower means both disposed in the drying chamber, said blower means, said heating means and said air shaft cooperating to produce a circulating dry air current flowing through the drying chamber, said drying chamber being located above said washing chamber, the outlet opening for the clean partial length of the towel being located near the top of the housing, said drying chamber having a passageway opening for the endless towel into said second storage chamber, a roller pair for advancing the endless towel being disposed in said drying chamber adjacent said passageway opening, and an ironing device located immediately upstream of said roller pair in travel direction of the endless towel.

5. Towel dispenser according to claim 4 wherein said ironing device comprises a pair of heatable ironing plates subjected to mutually opppsing pressure.

6. Towel dispenser according to claim 1 wherein said plurality of guide rollers in respective upper and lower regions of both the washing chamber and the drying chamber are disposed in mutually staggered relationship and are freely rotatable.

7. Automatic towel dispenser having a box-shaped housing provided with a mutually separated washing chamber and a drying chamber for an endless towel to be guided therethrough, an outlet opening and an inlet opening formed in said housing, the towel having a cleaned partial length thereof available for respective use and being guidable over a locking device for limiting the clean partial length of the towel to be dispensed and guided outside the housing between said outlet opening and said inlet opening formed in the housing, a first storage chamber, as viewed in travel direction of the towel, located in the housing between the inlet opening and the washing chamber for variably piling up therein a plurality of used partial lengths of the towel, and a second storage chamber, as viewed in travel direction of the towel, located in the housing between the drying chamber and the outlet opening for variably piling up therein a plurality of cleaned partial lengths of the towel, and means being activatable, upon the emptying to a given extent of the cleaned partial lengths of the towel in the second storage chamber, for passing used partial lengths of the towel through the washing and drying chamber after start-up of a washing and drying operation and for depositing cleaned partial lengths of the towel in the second storage chamber, the improvement therein comprising a plurality of guide rollers disposed in a respective upper and lower region of both the washing chamber and the drying chamber for guiding the endless towel in a multiplicity of loops, the washing chamber comprising at least one washing section and at least one rinsing section, said sections being separated by respective partitions, and air shaft separated by a partition from said drying chamber, heating means and blower means both disposed in the drying chamber, said blower means, said heating means and said air shaft cooperating to produce a circulating dry air current flowing through the drying chamber, and means for depositing and stacking the cleaned and dried partial lengths of the towel and the used partial lengths of the towel from above into the respective second and first storage chambers and for withdrawing them upwardly from below the stored supply disposed thereabove, and including respective overflows disposed within the individual washing and rinsing sections of the washing chamber, and electrically driven washing rollers disposed below the respective guide rollers at the upper region of the washing chamber and substantially at the level of said overflows between the individual loops of the endless towel.

8. Towel dispenser according to claim 7 wherein said guide rollers at the top of said washing chamber are respectively disposed over said partitions in spaced relationship to the respective upper edges of said partitions, and including additional washing rollers respectively mounted between said upper edges of said partitions and the respective guide rollers disposed thereover.

9. Towel dispenser according to claim 8 including means for driving the roller brushes disposed between the loops of the endless towel and the additional roller brushes mounted between the upper edges of the partitions and the respective guide rollers disposed thereover, and means operatively connected to said driving means for controlling said driving means in a thermostatically dependent manner.

10. Towel dispenser according to claim 1 wherein a roller pair disposed in said second storage chamber adjacent said outlet opening and cooperating with a counting mechanism for releasing the washing and drying operation, said roller pair being furthermore connected to a towel feed blocking device, a passageway opening connecting said drying chamber and said second storage chamber and another roller pair disposed in said drying chamber adjacent said passageway opening therefrom into said second storage chamber are all located at an upper part of said second storage chamber.

11. Towel dispenser according to claim 1 including an entrance to said washing chamber and wherein said inlet opening in said housing for the used partial length of the towel, a drivable roller pair disposed in said first storage chamber adjacent said inlet opening and a roller pair disposed in said washing chamber adjacent said entrance thereof from said first storage chamber are all located at an upper part of said storage chamber.

12. Towel dispenser according to claim 1 including a passageway opening connecting said drying chamber and said second storage chamber, a roller pair disposed in said drying chamber adjacent said passageway opening therefrom into said drying chamber, means for driving both of said roller pairs so as to advance the endless towel through said washing chamber and said drying chamber, and means operatively connected to said driving means for controlling said driving means in a thermostatically dependent manner.

13. Towel dispenser according to claim 12 including means for switching on said blower means in the drying chamber, said means for driving both of said roller pairs so as to advance the endless towel through said washing chamber and said drying chamber, as well as said means for switching on said blower means in the drying chamber, being operable in a thermostatically dependent manner.

14. Towel dispenser according to claim 1 including means for adding washing medium to said washing chamber, and means operatively connected to said means for adding washing medium for controlling the latter in a thermostatically dependent manner.

* * * * *